US007152527B2

(12) United States Patent
Dejima et al.

(10) Patent No.: US 7,152,527 B2
(45) Date of Patent: Dec. 26, 2006

(54) MODULE FOR SHEET-FED PERFECTING MULTI-COLOR PRINTING PRESS, PRINTING UNIT AND SHEET-FED PERFECTING MULTI-COLOR PRINTING PRESS, AND MANUFACTURING METHODS THEREFOR

(75) Inventors: Kazutada Dejima, Hiroshima-ken (JP); Shinichi Fujimoto, Hiroshima-ken (JP); Shinya Kobayashi, Hiroshima-ken (JP)

(73) Assignee: Mitsubishi Heavy Industries, Ltd., Tokyo (JP)

( * ) Notice: Subject to any disclaimer, the term of this patent is extended or adjusted under 35 U.S.C. 154(b) by 0 days.

(21) Appl. No.: 10/199,065

(22) Filed: Jul. 22, 2002

(65) Prior Publication Data

US 2003/0024423 A1 Feb. 6, 2003

(30) Foreign Application Priority Data

Aug. 2, 2001 (JP) ..... 2001-235034

(51) Int. Cl.
*B41F 5/00* (2006.01)
*B41F 33/00* (2006.01)

(52) U.S. Cl. ..... 101/216; 101/232; 101/416.1; 101/432; 101/483

(58) Field of Classification Search ..... 101/185, 101/183, 231, 227, 230, 177, 416.1, 216, 101/483, 232, 432
See application file for complete search history.

(56) References Cited

U.S. PATENT DOCUMENTS 2,898,851 A * 8/1959 Peyrebrune ..... 101/136
3,785,287 A * 1/1974 Dahlgren ..... 101/247
4,493,255 A * 1/1985 Fischer ..... 101/183
5,555,804 A * 9/1996 Kojima ..... 101/183

FOREIGN PATENT DOCUMENTS

| | | |
|---|---|---|
| JP | 58-147364 | 9/1983 |
| JP | 1-56672 | 11/1989 |
| JP | 6-336003 | 12/1994 |
| JP | 7-9654 | 1/1995 |
| JP | 2000-43228 | 2/2000 |
| JP | 2000-43229 | 2/2000 |
| JP | 2000-43230 | 2/2000 |
| JP | 2000-43231 | 2/2000 |

* cited by examiner

*Primary Examiner*—Daniel J. Colilla
*Assistant Examiner*—Marvin P. Crenshaw
(74) *Attorney, Agent, or Firm*—Armstrong, Kratz, Quintos, Hanson & Brooks, LLP

(57) ABSTRACT

An apparatus and a method in which when both of two-stage type and impression cylinder connecting type sheet-fed perfecting multi-color printing presses are manufactured, there is no need for a manufacture of extra parts or an extra stock, and also the replacement and servicing of parts are easy in the event of a failure of a printing unit or the sheet-fed perfecting multi-color printing press. For this purpose, modules for the printing unit for the sheet-fed perfecting multi-color printing press, each of which consists of a combination of at least two elements of a group consisting of an intermediate cylinder, impression cylinder, blanket cylinder, plate cylinder, inking mechanism, and water supply mechanism are manufactured, and the modules are used to manufacture the two-stage type and impression cylinder connecting type sheet-fed perfecting multi-color printing presses.

3 Claims, 5 Drawing Sheets

MODULE FOR SHEET-FED PERFECTING MULTI-COLOR PRINTING PRESS, PRINTING UNIT AND SHEET-FED PERFECTING MULTI-COLOR PRINTING PRESS, AND MANUFACTURING METHODS THEREFOR

BACKGROUND OF THE INVENTION

1. Field of the Invention

The present invention relates to a printing unit used for a perfecting multi-color printing press and a sheet-fed perfecting multi-color printing press containing such a printing unit, and manufacturing methods therefor.

More particularly, it relates to a printing unit used for a printing press, in which multi-color offset printing can be performed on both top and back surfaces of a sheet by one passing operation of sheet, and a sheet-fed perfecting multi-color printing press containing such a printing unit, and manufacturing methods therefor.

2. Description of the Related Art

Conventionally, as a sheet-fed perfecting multi-color printing press using a lithographic press technology represented by an offset printing press, what is called a press of a reversing type perfecting printing system, what is called a press of a B—B type perfecting printing system, and others are known.

As the above-mentioned reversing type perfecting printing system, there is available a press made up of a back surface printing section, a top surface printing section, a sheet reversing section, etc., in which after multi-color printing is performed on the back surface of a sheet by the back surface printing section, the sheet is reversed by the sheet reversing section and the reversed sheet is transferred to the top surface printing section, by which multi-color printing is performed on the top surface of the sheet by the top surface printing section (for example, Japanese Patent Publication No. 1-56672 (No. 56672/2001).

As the above-mentioned B—B type perfecting printing system, a printing unit is configured in which a plurality of blanket cylinders and impression cylinders with a rubber blanket affixed thereon are provided alternately in parallel with each other in the horizontal direction, a plate cylinder, ink mechanism, dampening water mechanism, etc., are provided above each of the blanket cylinders and below each of the impression cylinders. This printing unit is configured so that a gripper is provided on each of the blanket cylinders and impression cylinders, and during the time when a sheet is conveyed, multi-color printing is performed on both surfaces of the sheet at the same time has been disclosed in Japanese Patent Provisional Publication No. 58-147364 (No. 147364/1983).

In the reversing type perfecting printing system, the printing speed is lower than that of a one-side printing press, and the register accuracy of printing is liable to be degraded. Also, when the sheet size is changed, much labor and time is required for the change and adjustment of position of gripping using a gripper at the rear end of sheet, and a usable sheet size is limited. Further, a reversing mechanism requires two sheet transfer cylinders and a reversing cylinder, which presents a problem of increased total length of printing press.

Also, in the B—B type perfecting printing system, a delicate difference arises between the cylinder finish dimensions of the two blanket cylinders as a result of an error of blanket thickness, and thus mackle etc. sometimes occur. Also, in the B—B type perfecting printing system, there is no impression cylinder that serves as the reference plane at the time when a printing pressure is applied, which presents a problem of no sharpness of printed matter.

Therefore, as a technically preferred printing system, a press of a two-stage type represented by an same-floor type and a press of an impression cylinder connecting type are available.

As a press of the two-stage type represented by the same-floor type, Japanese Patent Provisional Publication No. 7-9654 (No. 9654/1995) has disclosed a sheet-fed perfecting multi-color printing press in which a top surface printing section, in which a blanket cylinder, a plate cylinder, and an inking mechanism are provided above an impression cylinder provided with a sheet gripper to form a top surface printing unit and a plurality of the top surface printing units are arranged in parallel, and a back surface printing section, in which a blanket cylinder, a plate cylinder, and an inking mechanism are provided below an impression cylinder provided with a sheet gripper to form a back surface printing unit and a plurality of the back surface printing units are arranged in parallel, are connected by impression cylinders so that a line connecting the axes of impression cylinders constituting the printing sections is substantially horizontal. Also, the Publication has disclosed a sheet-fed perfecting multi-color printing press in which a top surface printing section, in which a blanket cylinder, a plate cylinder, and an inking mechanism are provided above an impression cylinder provided with a sheet gripper to form a top surface printing unit and a plurality of the top surface printing units are arranged in parallel, and a back surface printing section, in which a blanket cylinder, a plate cylinder, and an inking mechanism are provided below an impression cylinder provided with a sheet gripper to form a back surface printing unit and a plurality of the back surface printing units are arranged in parallel, are connected by an even number of sheet transfer cylinders.

Specifically, a perfecting printing operation is performed by the two-stage type in which a plurality of top surface printing units are arranged in parallel to perform printing on top surface and then a plurality of back surface printing units are arranged in parallel to perform printing on back surface.

In this case, especially in the latter press, the height of an equipment portion for printing on the opposite surface after printing on one surface has been finished can be adjusted. Therefore, by using what is called an same-floor type as shown in FIG. 1, the construction of the whole printing press can be made compact.

As a press of an impression cylinder connecting type, Japanese Patent Provisional Publication No. 6-336003 (No. 336003/1994) discloses a sheet-fed perfecting printing press. This printing press is constructed so that a blanket cylinder, a plate cylinder, and an inking mechanism are provided above an impression cylinder provided with a sheet gripper to form a top surface printing unit, and a blanket cylinder, a plate cylinder, and an inking mechanism are provided below an impression cylinder provided with a sheet gripper to form a back surface printing unit. The top surface printing unit and the back surface printing unit are connected to each other by the impression cylinders constituting the printing units.

Comparing the two-stage type and the impression cylinder connecting type, in the former type, the printing on the back surface is started after the printing on the top surface has been finished, so that there is less fear of stained prints. Also, in the former type, when the number of colors used on the top and back surfaces is different, there is less need for providing useless equipment. On the other hand, it is less compact than the latter type.

On the other hand, although the latter type is superior to the former type in compactness, it is unsuitable to the printing on thick sheets, and in the latter type, there is a fear of stained prints because printing operations on the top and back surfaces are performed alternately. Also, the latter type has a drawback in that the same number of printing units are required even when the number of colors used on the top and back surfaces is different.

For these reasons, at present, the above-mentioned two types are practically used according to the purposes for which they are used.

SUMMARY OF THE INVENTION

The present has been made in view of the above situation, and accordingly an object thereof is to find a means for rationally manufacturing both of a stage-type sheet-fed perfecting multi-color printing press using a lithographic press technology represented by an offset printing press and an impression cylinder connecting type sheet-fed perfecting multi-color printing press.

Other objects and advantages of the present invention will appear in the course of the description thereof which follows.

One aspect of the present invention provides a module for a printing unit for a sheet-fed perfecting multi-color printing press, which consists of a combination of at least two elements of a group consisting of an intermediate cylinder, impression cylinder, blanket cylinder, plate cylinder, inking mechanism, and water supply mechanism, and a printing unit and a sheet-fed perfecting multi-color printing press, which are assembled by using the module.

Through the whole of this specification, unless otherwise described, the "module" may contain other parts. Therefore, the case where the "module" contains other parts falls within the scope of the present invention unless it deviates from the teachings of the present invention.

Also, hereunder, symbols of (A), (A'), (B), (B'), etc. are used to distinguish modules from each other. These symbols are used only for convenience in understanding the contents of drawings, and do not restrict the scope of the present invention.

The printing unit for the sheet-fed perfecting multi-color printing press generally includes parts such as an intermediate cylinder, impression cylinder, blanket cylinder, plate cylinder, inking mechanism, and water supply mechanism.

On the other hand, a two-stage type sheet-fed perfecting multi-color printing press uses two types of printing units, each consisting of an intermediate cylinder, impression cylinder, blanket cylinder, plate cylinder, inking mechanism, and water supply mechanism, for top surface printing and back surface printing. Parts used for these two types of units cannot often be used in common for the reason of configuration such as installation position of a motor and other parts, so that different parts must be used for the two types of units. Therefore, in manufacturing the two-stage type sheet-fed perfecting multi-color printing press, parts necessary for the two types must be manufactured and retained as stocks.

The same holds for an impression cylinder connecting type sheet-fed perfecting multi-color printing press. The impression cylinder connecting type sheet-fed perfecting multi-color printing press uses two types of printing units, each consisting of an impression cylinder, blanket cylinder, plate cylinder, inking mechanism, and water supply mechanism, for top surface printing and back surface printing. Parts used for these two types of units cannot often be used in common for the reason of configuration such as installation position of a motor and other parts, so that different parts must be used for the two types of units. Therefore, in manufacturing the impression cylinder connecting type sheet-fed perfecting multi-color printing press, parts necessary for the two types must be manufactured and retained as stocks.

Therefore, when both of the two-stage type and impression cylinder connecting type sheet-fed perfecting multi-color printing presses are manufactured, many parts are handled.

To the contrary, when the above-mentioned two types of sheet-fed perfecting multi-color printing presses are manufactured, parts can be modularized as described above. It has been found that by the modularization, a need for a manufacture of extra parts or an extra stock is eliminated.

Also, if a printing unit or a sheet-fed perfecting multi-color printing press, which is assembled by using such a module, fails, the replacement and servicing of parts are easy, so that the modularization is also advantageous in terms of maintenance.

Another aspect of the present invention provides manufacturing methods for the printing unit for the sheet-fed perfecting multi-color printing press and the sheet-fed perfecting multi-color printing press, in which such a module is manufactured in the course of the manufacturing methods.

If the above-described manufacturing methods including the manufacture of module are used, there is no need for a manufacture of extra parts or an extra stock, so that the two-stage type and impression cylinder connecting type sheet-fed perfecting multi-color printing presses can be manufactured rationally.

Also, the replacement and servicing of parts are easy in the event of a failure of the printing unit or the sheet-fed perfecting multi-color printing press.

When only either type of printing press is manufactured, the replacement and servicing of parts are easy in the event of a failure of the printing unit or the sheet-fed perfecting multi-color printing press, and concerning the part stocks necessary during manufacture, unreasonableness such that particular parts are retained as stocks more than necessary is excluded easily, which achieves an effect of easy inventory control.

Other objects and advantages of the present invention will be apparent from the embodiments and drawings explained below.

DETAILED DESCRIPTION OF THE PREFERRED EMBODIMENTS

Figure 1:
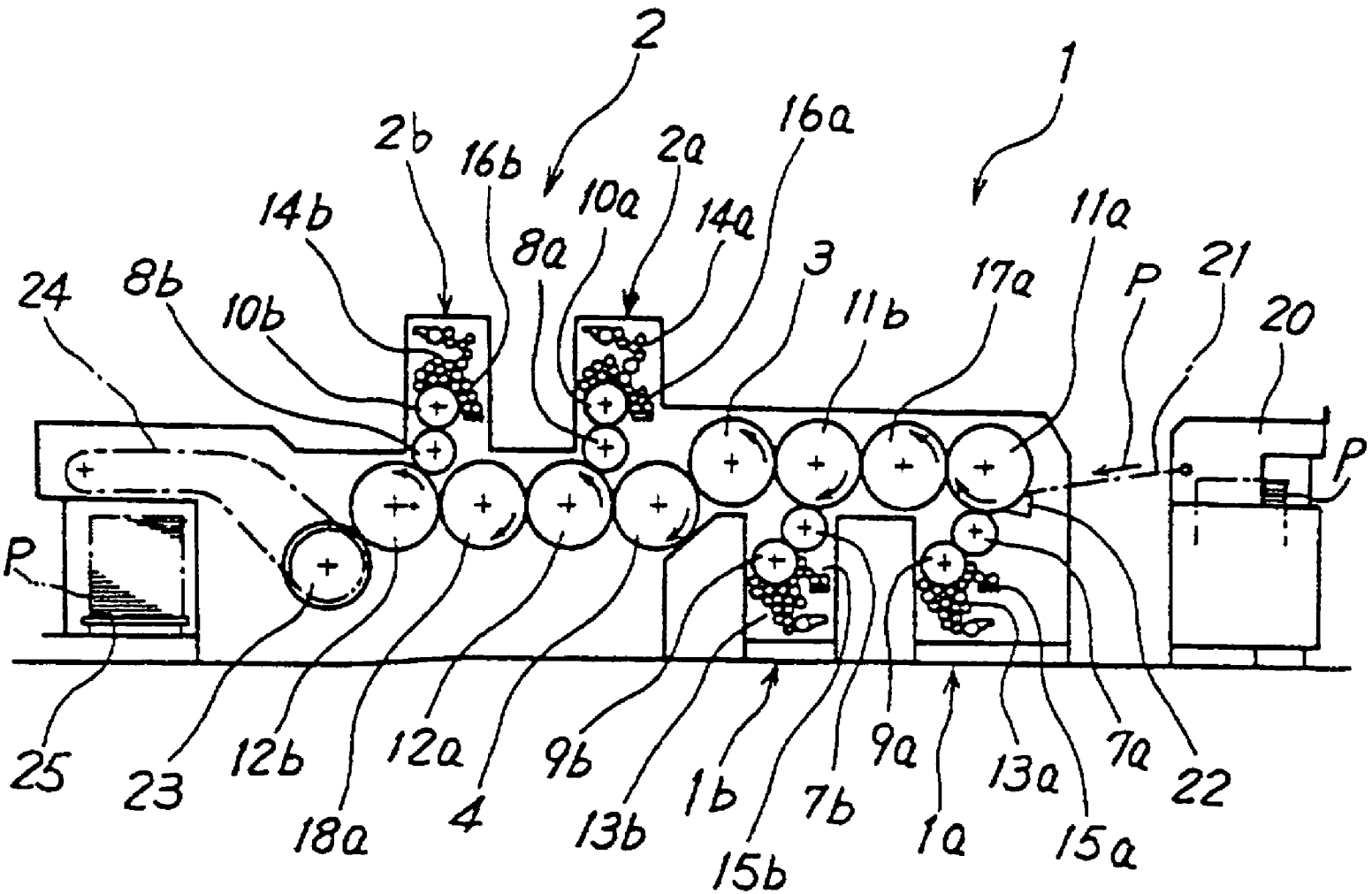
FIG. 1 is a schematic side view of a two-stage type sheet-fed perfecting two-color printing press.

Embodiments of the present invention will now be described with reference to the accompanying drawings. In some cases, the same reference numerals are applied to the same elements. In this specification, in all figures, a gripper for moving a sheet is not shown for simplification.

The embodiments of the present invention shown and described hereunder are to be taken as preferred examples of the same, and do not restrict the scope of the present invention. It will be appreciated that other embodiments can fall within the scope of the present invention unless they deviate from the teachings of the present invention.

FIG. 1 is a schematic side view of a sheet-fed perfecting two-color printing press, showing one example of a two-stage type sheet-fed perfecting multi-color printing press.

The printing press of this example is made up of a back surface printing section 1, in which back surface printing units 1*a* and 1*b* for a first color and a second color are arranged in parallel, and a top surface printing section 2, in which top surface printing units 2*a* and 2*b* for a first color and a second color are arranged in parallel, provided on the rear side of the back surface printing unit 1.

The back surface printing unit 1*a* for the first color includes a blanket cylinder 7*a*, a plate cylinder 9*a*, an impression cylinder 11*a*, an inking mechanism 13*a*, and a water supply mechanism 15*a*, and is formed by connecting the blanket cylinder 7*a*, the plate cylinder 9*a*, the inking mechanism 13*a*, and the water supply mechanism 15*a* below the impression cylinder 11*a*. A sheet P passes between the impression cylinder 11*a* and the blanket cylinder 7*a*, by which printing is performed on the back surface thereof.

The back surface printing unit 1*b* for the second color is formed, like the back surface printing unit 1*a* for the first color, by connecting a blanket cylinder 7*b*, a plate cylinder 9*b*, an inking mechanism 13*b*, and a water supply mechanism 15*b* below an impression cylinder 11*b*.

Between the impression cylinders 11*a* and 11*b* of the back surface printing units 1*a* and 1*b* for the first and second colors is provided an intermediate cylinder 17*a*, by which the back surface printing section 1 connected almost linearly in the horizontal direction is formed.

Also, the top surface printing unit 2*a* for the first color is formed, like the back surface printing units 1*a* and 1*b*, by connecting a blanket cylinder 8*a*, a plate cylinder 10*a*, an inking mechanism 114*a*, and a water supply mechanism 16*a* above an impression cylinder 12*a*.

The top surface printing unit 2*b* for the second color is formed like the top surface printing unit 2*a* for the first color, and the impression cylinders 12*a* and 12*b* forming the top surface printing units 2*a* and 2*b* for the first and second colors are connected almost linearly in the horizontal direction via an intermediate cylinder 18*a*, by which the top surface printing section 2 is formed.

Sheets P stacked in a sheet feeder 20 are fed successively to the impression cylinder 11*a* of the back surface printing unit 1*a* for the first color via a feeder board 21 and a swing device 22, and printing of the first color is performed on the back surface thereof. Next, the sheet P is transferred to the impression cylinder 11*b* of the back surface printing unit 1*b* for the second color to perform printing of the second color on the back surface thereof.

Subsequently, the sheet P is fed to the impression cylinder 12*a* of the top surface printing unit 2*a* of the first color, which forms the top surface printing section 2, via sheet transfer cylinders 3 and 4 to perform printing of the first color on the top surface thereof. Next, the sheet P is transferred to the impression cylinder 12*b* of the top surface printing unit 2*b* for the second color via the intermediate cylinder 18*a* to perform printing of the second color on the top surface thereof. Thus, two-color printing can be performed on both top and back surfaces of the sheet P.

Reference numeral 23 denotes a sprocket, and 24 denotes a delivery chain with grippers which is driven by the sprocket 23. The sheet P having been subjected to printing is delivered from the rearmost impression cylinder 12*b* onto a delivered sheet stand 25 by means of the delivery chain 24 with grippers.

The relative positions of the axis line of the impression cylinders 11*a* and 11*b* forming the back surface printing section 1 and the axis line of the impression cylinders 12*a* and 12*b* forming the top surface printing section 2 can be changed vertically by the presence of the sheet transfer cylinders 3 and 4. Thereby, the height of the top surface printing section 2 for performing printing of the second color is lowered, whereby the sheet-fed perfecting multi-color printing press can be made compact. Such a two-stage type sheet-fed perfecting multi-color printing press is referred to as an same-floor type sheet-fed perfecting multi-color printing press. The sheet P can be transferred directly from the impression cylinder 11*b* to the top surface printing section 2 without the use of the sheet transfer cylinders 3 and 4. In the present invention, the two-stage type sheet-fed perfecting multi-color printing press includes both of the above-mentioned two types.

Figure 2:
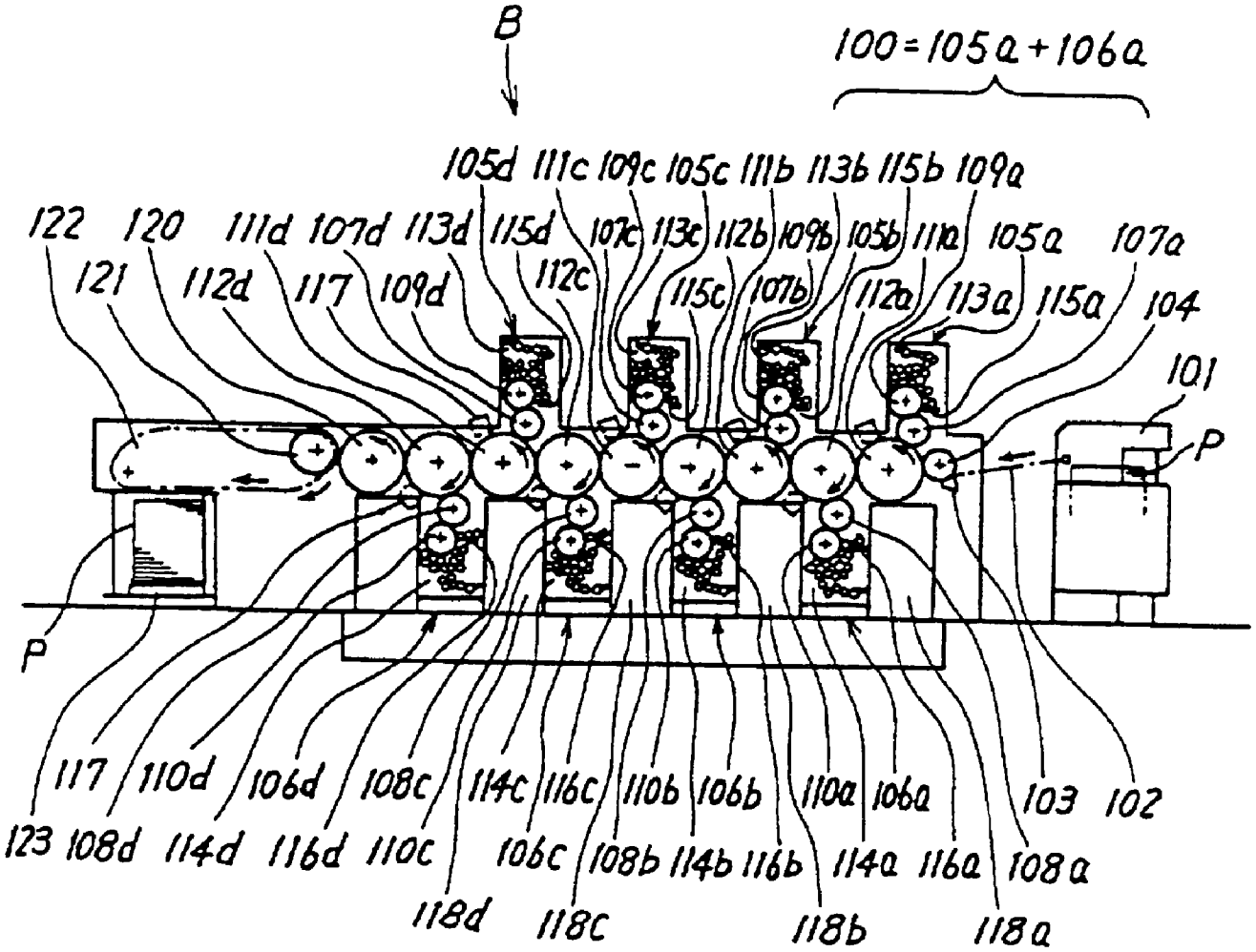
FIG. 2 is a schematic side view of an impression cylinder connecting type sheet-fed perfecting two-color printing press.

FIG. 2 is a schematic side view of a sheet-fed perfecting two-color printing press, showing one example of an impression cylinder connecting type sheet-fed perfecting multi-color printing press.

Sheets P stacked in a feeder body 20 are fed successively to a printing section 100 via a feeder board 102 and a swing device 103, and a transfer cylinder 104, and printing is performed on the top and back surfaces thereof.

The printing section 100 consists of one top surface printing unit 105*a* and one back surface printing unit 106*a*.

The top surface printing unit 105*a* is forced by connecting a blanket cylinder 107*a*, a plate cylinder 109*a*, an inking mechanism 113*a*, and a water supply mechanism 115*a* above an impression cylinder 111*a*.

Also, the back surface printing unit 106*a* is formed by connecting a blanket cylinder 108*a*, a plate cylinder 110*a*, an inking mechanism 114*a*, and a water supply mechanism 116*a* below an impression cylinder 112*a*. At the right-hand side of the back surface printing unit 106*a* is provided a work space 118*a*.

The impression cylinder connecting type sheet-fed perfecting printing press is constructed by connecting the top surface printing unit 105a and the back surface printing unit 106*a*, which are formed as described above, in such a manner that the impression cylinders are brought into contact. In this case, the impression cylinders 111*a* and 112*a* forming the top and back surface printing units 105*a* and 106*a*, respectively, are connected to each other in the horizontal direction. In some cases, the impression cylinders 111*a* and 112*a* are connected to each other in such a manner that the line connecting the axes of impression cylinders is a slant line. Reference numeral 117 denotes an ink drier provided near each of the impression cylinders 111 and 112 (111*a*, 112*a*, etc.).

By the above-described construction, the sheet P is transferred from the transfer cylinder 104 to the impression cylinder 111*a* of the top surface printing unit 105*a* to perform printing on the top surface thereof, and then transferred to the impression cylinder 112*a* of the back surface printing unit 106*a* to perform printing on the back surface thereof.

Reference numeral 120 denotes a delivery cylinder connected to an impression cylinder 112*d*, 121 denotes a sprocket, and 122 denotes a delivery chain with grippers which is driven by the sprocket 121. The sheet P having been subjected to printing is delivered from the impression cylinder 112*d* onto a delivered sheet stand 123 via the delivery cylinder 120 by means of the delivery chain 122 with grippers.

In the case where the two-stage type sheet-fed perfecting multi-color printing press and the impression cylinder connecting type sheet-fed perfecting multi-color printing press, which are described above, are manufactured in parallel or alternately at the same factory, a module for printing unit for the sheet-fed perfecting multi-color printing press, which consists of a combination of at least two elements of a group consisting of an intermediate cylinder, impression cylinder, blanket cylinder, plate cylinder, inking mechanism, and water supply mechanism, is first assembled. If a printing unit or a sheet-fed perfecting multi-color printing press is manufactured by using this module, great advantages are provided because a need for a manufacture of extra parts or an extra stock is eliminated. Also, for the printing unit or the sheet-fed perfecting multi-color printing press assembled by using the above-described module, the replacement and servicing of parts are easy in the event of part failure, so that the use of module is also advantageous in terms of maintenance.

Figure 3:
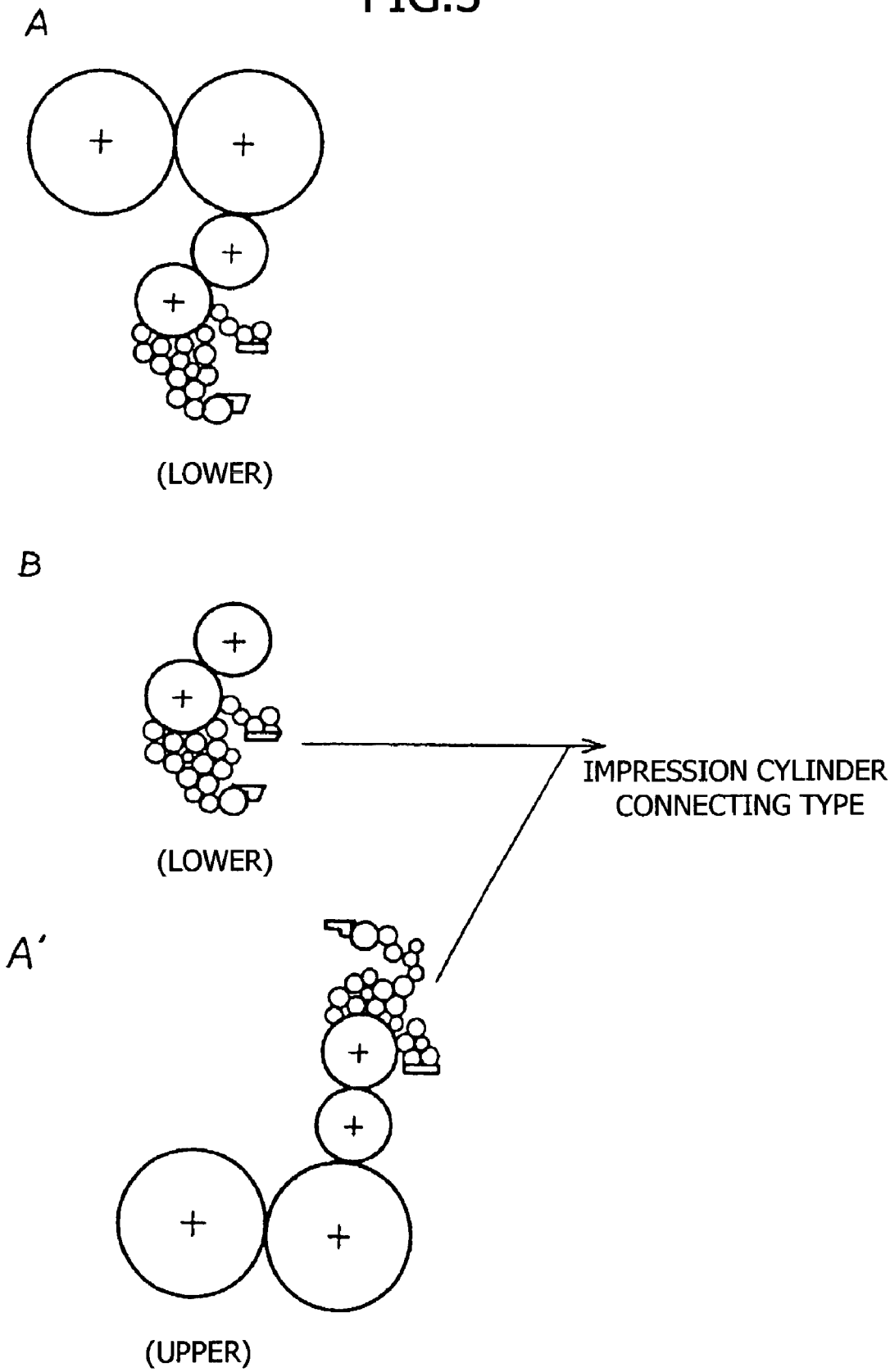
FIG. 3 is a schematic view showing an example of a module.

For example, for the two-stage type sheet-fed perfecting multi-color printing press, as shown in FIG. 3, two types of modules A and A' consisting of an intermediate cylinder, impression cylinder, blanket cylinder, inking mechanism, and water supply mechanism are assembled as two printing units.

In addition, as shown in FIG. 3, a module B consisting of a blanket cylinder, plate cylinder, inking mechanism, and water supply mechanism is manufactured. Thereby, by replacing the intermediate cylinder of the module A' with the impression cylinder and by combining this with the module B, two printing units for the impression cylinder connecting type sheet-fed perfecting multi-color printing press can be assembled.

Therefore, as modules, the module A, module A', and module B have only to be prepared.

In place of the module consisting of an intermediate cylinder, impression cylinder, blanket cylinder, inking mechanism, and water supply mechanism, a module consisting of two impression cylinders, a blanket cylinder, plate cylinder, inking mechanism, and water supply mechanism may be manufactured as one of alternatives.

Figure 4:
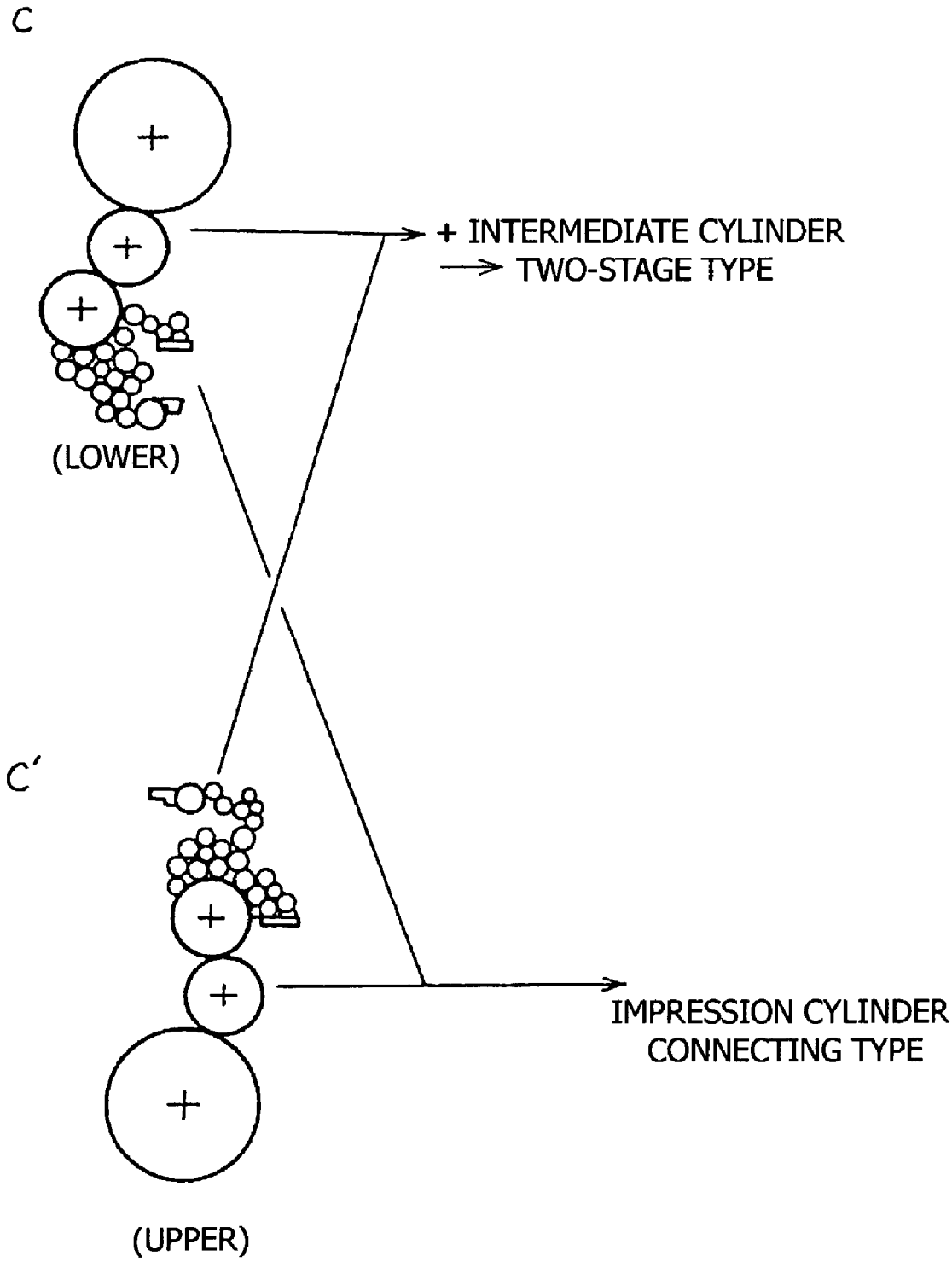
FIG. 4 is a schematic view showing another example of a module.
Figure 5:
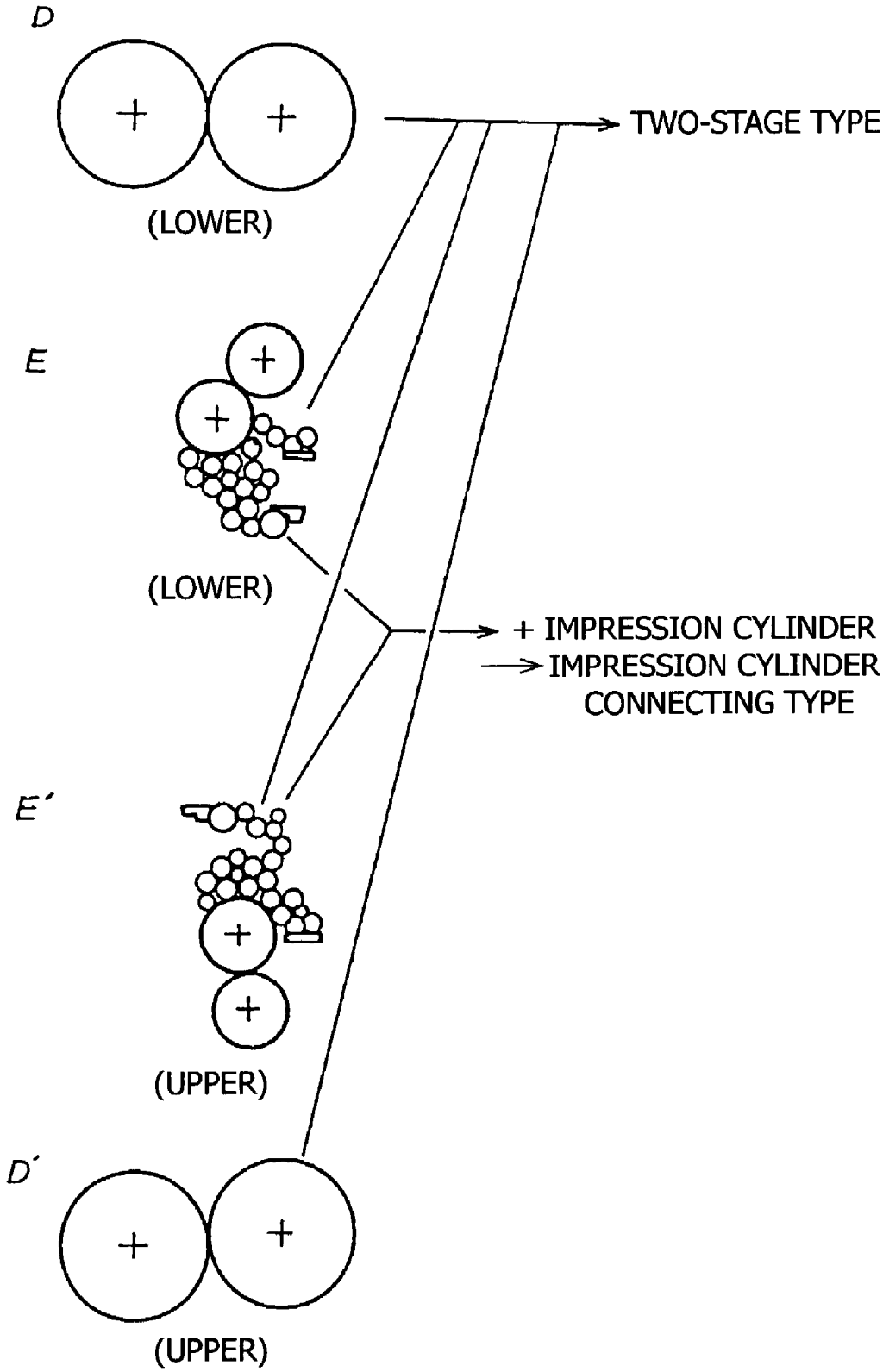
FIG. 5 is a schematic view showing still another example of a module.

In FIGS. 3 to 5, the largest circle represents an intermediate cylinder or an impression cylinder, two circles of a medium size represent a blanket cylinder and a plate cylinder, and a portion containing a collection of small circles represents an inking mechanism and a water supply mechanism. Also, (UPPER) in the figures means a module used for assembling the upside unit in the printing presses in FIGS. 1 and 2, and (LOWER) in the figures means a module used for assembling the downside unit in the printing presses in FIGS. 1 and 2.

If two types of modules, module C and module C', for the sheet-fed perfecting multi-color printing press consisting of an impression cylinder, blanket cylinder, plate cylinder, inking mechanism, and water supply mechanism, as shown in FIG. 4, are prepared, one printing unit for the two-stage type sheet-fed perfecting multi-color printing press can be manufactured of the module C and an intermediate cylinder, and another printing unit can be manufactured of the module C' and an intermediate cylinder.

Further, a printing unit for the impression cylinder connecting type sheet-fed perfecting multi-color printing press consisting of the modules C and C' can be manufactured.

Also, if two types of modules, module D and module D', for the sheet-fed perfecting multi-color printing press consisting of an intermediate cylinder and an impression cylinder, and two types of modules, module E and module E', for the sheet-fed perfecting multi-color printing press consisting of a blanket cylinder, plate cylinder, inking mechanism, and water supply mechanism, as shown in FIG. 5, are prepared, two types of printing units for the two-stage type sheet-fed perfecting multi-color printing press can be manufactured. Also, for the impression cylinder connecting type sheet-fed perfecting multi-color printing press, by combining the modules E and E' with the impression cylinder, two types of printing units can be manufactured.

By appropriately combining the modules prepared as described above, a printing unit for the two-stage type and impression cylinder connecting type sheet-fed perfecting multi-color printing presses can be manufactured, and by using the printing unit manufactured as described above, two-stage type and impression cylinder connecting type sheet-fed perfecting multi-color printing presses can be manufactured.

As a result of the above-described study, it has been found that it is useful that the impression cylinder and the blanket cylinder are separated from each other, and a module is manufactured so as to contain only either one of the impression cylinder and the blanket cylinder.

A configuration such that the impression cylinder and the blanket cylinder can be separated from each other has so far been thought to be disadvantageous in terms of the adjustment of printing pressure and the stability. Therefore, when parts are assembled into a printing unit, there has been no idea that an intermediate part in which an impression cylinder and a blanket cylinder are separated from each other is manufactured in the course of manufacture of printing unit. However, it has been found that this configuration is very advantageous from the viewpoint of modularization, and the problem of printing pressure can be overcome by proper consideration in designing, which has led to the completion of the present invention.

Such modularization can be adopted not only when both of the two-stage type and impression cylinder connecting type sheet-fed perfecting multi-color printing presses are manufactured but also when only either one of them is manufactured.

When both of the two-stage type and impression cylinder connecting type sheet-fed perfecting multi-color printing presses are manufactured, there is no need for a manufacture of extra parts or an extra stock.

Also, if the printing unit or the sheet-fed perfecting multi-color printing press fails, the replacement and servicing of parts are easy.

When only either type of printing press is manufactured, the replacement and servicing of parts are easy in the event of a failure of the printing unit or the sheet-fed perfecting multi-color printing press, and concerning the part stocks necessary during manufacture, unreasonableness such that particular parts are retained as stocks more than necessary is excluded easily, which achieves an effect of easy inventory control.

The invention claimed is:

1. A method of making a printing unit for a sheet-fed perfecting multi-color printing press from independent replaceable modules, each module comprising a combination of at least two elements of a group consisting of an intermediate cylinder, impression cylinder, blanket cylinder, plate cylinder, inking mechanism, and water supply mechanism, the method comprising the steps, of:

assembling the printing unit from a plurality of the independent modules, the printing unit including two types of modules A and A', each including an intermediate cylinder, an impression cylinder, blanket cylinder, plate cylinder, inking mechanism, and water supply mechanism, and a module B for a sheet-fed perfecting multi-color printing press including a blanket cylinder, plate cylinder, inking mechanism, and water supply mechanism; and assembling a top surface printing unit and a back surface printing unit by combining said modules A, A' with module B, in which said modules A and A', each having an intermediate cylinder, are used in said printing unit when a unit for a two-stage type sheet-fed perfecting multi-color printing press is assembled; and assembling a top surface printing unit and a back surface printing unit by combining said A, A' with module B, in which the intermediate cylinder of module A' is replaced with the impression cylinder so that the module A' in which the intermediate cylinder is replaced with the impression cylinder and module B are used when a unit for an impression cylinder of module B connection type sheet-fed perfecting multi-color printing press is assembled.

2. A method of making a printing unit for a sheet-fed perfecting multi-color printing press from independent replaceable modules, each module comprising a combination of at least two elements of a group consisting of an intermediate cylinder, impression cylinder, blanket cylinder, plate cylinder, inking mechanism, and water supply mechanism, the method comprising the steps of:

assembling the printing unit from a plurality of the independent modules, the printing unit including two types of modules C and C' for a sheet-fed perfecting multi-color printing press, each including an impression cylinder, blanket cylinder, plate cylinder, inking mechanism, and water supply mechanism; and assembling a top surface printing unit and a back surface printing unit by combining said modules C and C', in which an intermediate cylinder is intervened between the impression cylinders of said modules C and C' when a unit for a two-stage type sheet-fed perfecting multi-color printing press is assembled; and assembling a top surface printing unit and a back surface printing unit by combining said modules C and C', in which the impression cylinders of said modules C and C' are directly disposed in parallel with each other when a unit for an impression cylinder connection type sheet-fed perfecting multi-color printing press is assembled.

3. A method of making a printing unit for a sheet-fed perfecting multi-color printing press from independent replaceable modules, each module comprising a combination of at least two elements of a group consisting of an intermediate cylinder, impression cylinder, blanket cylinder, plate cylinder, inking mechanism, and water supply mechanism, the method comprising the steps of:

assembling the printing unit from a plurality of the independent modules, the printing unit including two types of modules D and D' for a sheet-fed perfecting multi-color printing press, each including an intermediate cylinder and an impression cylinder, and two types of modules E and E' for a sheet-fed perfecting multi-color printing press each including a blanket cylinder, plate cylinder, inking mechanism, and water supply mechanism;

assembling a unit for a two-stage type sheet-fed perfecting multi-color printing press by combining said modules D, D' with modules E, E'; or assembling a unit for an impression cylinder connection type sheet-fed perfecting multi-color printing press by combining said modules E, E' with only impression cylinders.

* * * * *